US005518249A

United States Patent [19]

Sines et al.

[11] Patent Number: 5,518,249

[45] Date of Patent: May 21, 1996

[54] CARDS AND METHODS FOR PLAYING BLACKJACK

[75] Inventors: Randy D. Sines, Spokane, Wash.; Steven L. Forte, Henderson, Nev.

[73] Assignee: Sines & Forte, Henderson, Nev.

[21] Appl. No.: 353,526

[22] Filed: Dec. 8, 1994

Related U.S. Application Data

[63] Continuation-in-part of Ser. No. 165,302, Dec. 9, 1993, Pat. No. 5,403,015, which is a continuation-in-part of Ser. No. 28,882, Sep. 23, 1994, Pat. No. 5,345,028.

[51] Int. Cl.[6] ..... A63F 1/00

[52] U.S. Cl. ..... 273/304; 273/292; 273/307

[58] Field of Search ..... 273/292, 303–307; D21/45, 44, 42

[56] References Cited

U.S. PATENT DOCUMENTS

| | | | |
|---|---|---|---|
| 56,072 | 8/1920 | Loring | D21/44 |
| D. 85,407 | 8/1931 | Weintraub | D21/45 |
| D. 87,084 | 5/1932 | Schaeffer | D21/45 |
| D. 134,118 | 10/1942 | Demorest | D21/45 |
| D. 170,269 | 8/1953 | Nekuda | D21/42 |
| D. 195,634 | 7/1963 | Saxon | D21/45 |
| D. 222,782 | 12/1971 | Dibrell | D21/45 |
| D. 230,617 | 3/1974 | Ekstrand | 273/292 |
| 1,798,672 | 3/1931 | Hines | 273/296 |
| 2,639,922 | 5/1953 | Laycott | 273/306 |
| 4,014,549 | 3/1977 | Cywar | 273/304 |
| 5,039,102 | 8/1991 | Miller | 273/148 R |
| 5,224,712 | 7/1993 | Laughlin et al. | 273/304 |
| 5,403,015 | 5/1995 | Forte et al. | 273/304 |

OTHER PUBLICATIONS

The Way To Play by the Diagram Group, pp. 80–81, Paddington Press, Ltd. 1976.

*Primary Examiner*—Benjamin H. Layno

*Attorney, Agent, or Firm*—Wells, St. John, Roberts, Gregory & Matkin

[57] ABSTRACT

A playing card deck for playing blackjack or casino twenty-one. The cards preferably have diagonally opposing primary and secondary corners. All cards in the deck have indicia or markings at the primary corners which indicate the nature of the card (suit and card type). The deck has two groupings of cards. The secondary corners of the first group do not indicate the specific nature or count of the card. The secondary corners of the second group, such as aces, have secondary indicia. This allows a dealer to selectively peek at the secondary corner of his face-down card to determine whether a blackjack hand exists. If blackjack does not exist, then the dealer does not know the face-down card and cheating or unintentional disclosure is prevented.

24 Claims, 10 Drawing Sheets

CARDS AND METHODS FOR PLAYING BLACKJACK

CROSS-REFERENCES TO RELATED APPLICATIONS

This is a continuation-in-part of U.S. patent application Ser. No. 08/165,302 filed Dec. 9, 1993, now U.S. Pat. No. 5,403,015. This is also a continuation-in-part of U.S. patent application Ser. No. 29/028,882 filed Sep. 23, 1993, now U.S. Pat. No. 5,345,028.

TECHNICAL FIELD

The technical field of this invention is card decks and methods of playing the casino card game alternatively called blackjack, casino twenty-one, or simply twenty-one. The methods and card decks provide increased protection for casinos against cheating and inadvertent disclosure by dealers.

BACKGROUND OF THE INVENTION

The card game twenty-one or blackjack is a very popular card game. It is particularly popular as a casino card game involving betting. In casinos the house typically holds the dealer hand. The basic object of the game is to obtain a combined card count which beats the count of the dealer without going over twenty-one. The game is played with a common card deck or multiple decks. Each deck has four suits of thirteen cards each, for a total fifty two cards in a deck. Each suit has an ace, numerically indexed cards from two to ten, and face cards. The ace cards are jacks, queens and kings.

In casinos, each game of blackjack is carefully monitored by one or more supervisory personnel. The supervisory personnel monitor the counts of the displayed cards and the amounts of the dealer's payments to protect the house from crooked dealers and crooked players. The games are typically monitored through an optical device mounted to the ceiling of the casino, the so-called "eye-in-the-sky." The supervisory personnel must quickly ascertain the value of the played cards to determine that the gaming parties are playing fairly. Due to the distance between the eye-in-the-sky and the game tables, the supervisory personnel generally have a poor view of the cards. Thus, it is required that the personnel be able to quickly detect the count of the played cards even though the personnel are viewing the cards from a significant distance.

In the play of blackjack the dealer initially deals two cards to each player and the dealer. The cards are dealt one at a time around the table. The initial two cards to the players are either dealt both facedown or both faceup, depending upon the rules of the particular blackjack table or casino involved.

The dealer receives one card faceup and the other initial card facedown. The faceup card is also called the "upcard". The face-down card is also called the "hole card". An initial wager is placed before dealing the first two cards in casino games. After the first two cards are dealt to all players, each player is offered a variety of options including: standing, hitting, splitting and doubling down. The player directs the dealer to deal zero, one or more additional cards to that particular player. Rules of betting and play vary from casino to casino. If the player's total hand count exceeds twenty-one, then the player loses and this is often called a "bust". If the player holds with cards which count a total of twenty-one or less, then he is still in and the next player makes similar decisions about betting and additional cards. The dealer plays last and is instructed by the house to hold when a certain count is achieved, typically 17 or higher.

If the dealer has a ten-count card and an ace after the first two cards, then the dealer wins. This hand is typically referred to as "blackjack" or "natural". The only exception to the dealer's winning blackjack hand, is when a player also has a blackjack hand. It is desirable to know after the first two cards are dealt whether the dealer has a blackjack and the hand can be ended. This is particularly important in casinos because playing the hand out requires time. Fully playing the hand reduces the total volume of gambling which occurs in a given time period. Thus, the casino industry has typically desired to have the dealer look at his hole card and then terminate play if there is a dealer blackjack.

Having the dealer complete play in this manner has some derogatory effects. If the dealer looks at the face-down card, then the dealer knows what his hand counts. This knowledge can be intentionally or unintentionally divulged by the dealer to the detriment of the house. The derogatory effect can occur because the other players may alter their betting and demands for additional cards if they have additional knowledge of the dealer's hole card. Divulgence by the dealer of his hand is most obviously a problem when the dealer is in complicity with a player in an effort to take advantage of the house. Such schemes have been previously tried and effected to the loss of the casino. Less obvious are instances where the dealer subconsciously divulges the count of the dealer's hand to other players. This can occur when a dealer reacts in a way which is indicative of an unfavorable or favorable card count after peeking at the hole card.

Because of these concerns, it is sometimes decided by casino owners or managers that the dealer will not look at the hole card until the hands of the other players have been played. However, this increases the playing time of the hand when the dealer has a blackjack hand. These considerations have resulted in a conundrum for casino owners and managers as to which is the best approach.

This problem has been previously addressed by a casino twenty-one system which utilizes a specially constructed table having an optical sensor. If the face up card is a ten-count card or ace, then the dealer scans the face-down card across the scanner. The face-up card is entered manually or automatically. Electronics determine whether the card is the card needed to provide a blackjack hand, without the dealer looking at the face of the card.

Other systems have been devised which use mirrors and prisms. These systems have the dealers position the hole card adjacent the mirrors or prisms for selective determination whether the hole card is the other member of a blackjack pair.

These approaches attempt to prevent the dealer from looking at the face-down or hole card. This prevents the dealer from consciously or subconsciously divulging the hand. If the dealer's hand is a blackjack, then play of the hand is ended, and time is saved. The saved time translates into increased revenues for the casino because a larger volume of gambling can occur within the operating hours available.

BRIEF DESCRIPTION OF THE DRAWINGS

One or more preferred forms of the invention are described herein with reference to the accompanying drawings. The drawings are briefly described below.

FIG. 10 is a diagrammatic face view illustrating cards contained in a first group of cards forming a part of a second alternative preferred card deck according to this invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
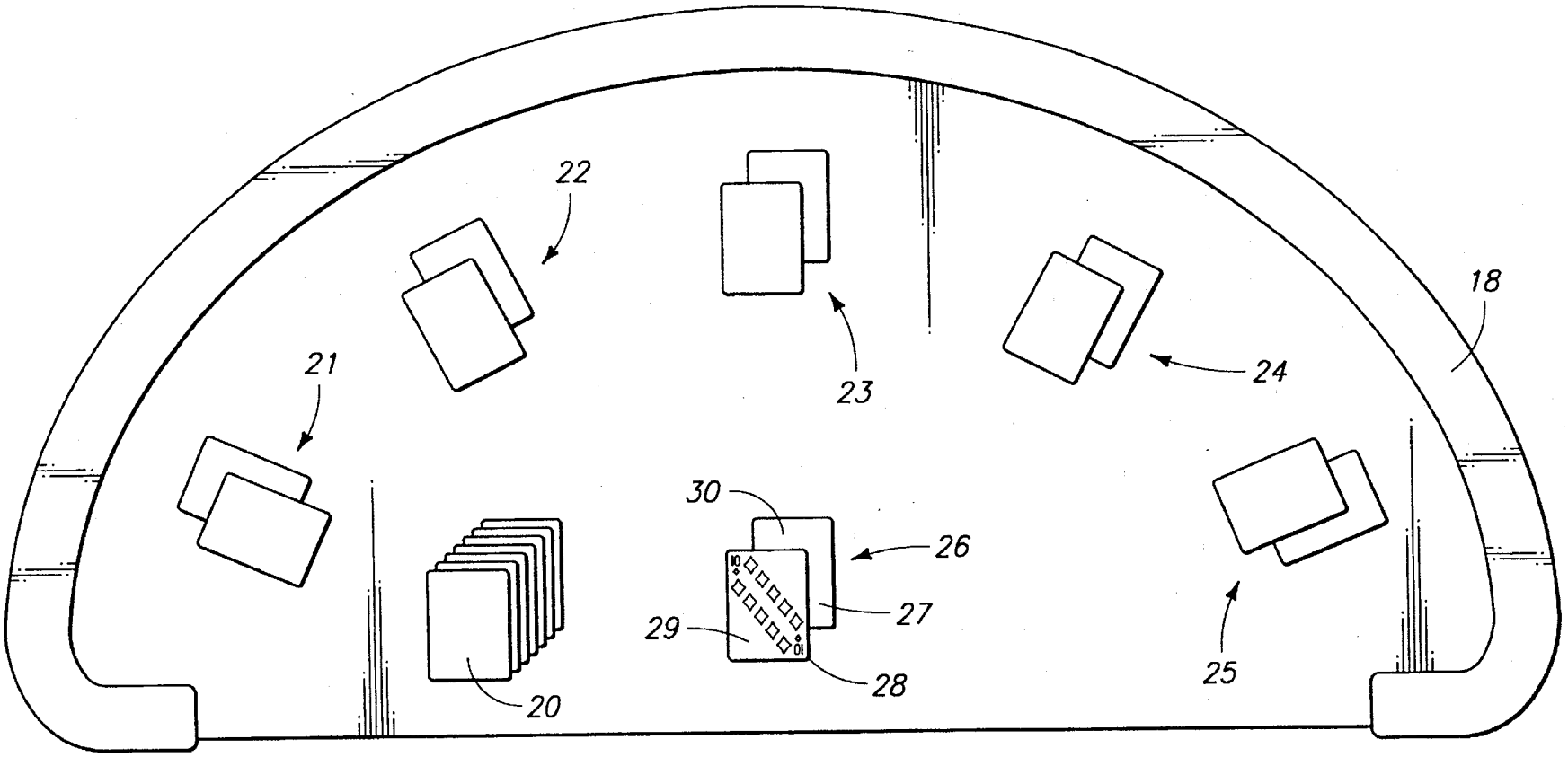
FIG. 1 is an overhead or plan view showing the top of a blackjack table with player and dealer hands thereon.

FIG. 1 shows a blackjack table 18 equipped with a novel deck of cards 20 made in accordance with this invention. The deck of cards 20 has been partially dealt to produce the initial two-card hands for five players and a dealer. The first, second, third, fourth, and fifth player hands are identified by the reference numerals 21–25, respectively. The dealer's hand is identified by the reference numeral 26. All player hands are dealt with two face-down cards. The dealer has one face-down card and one face-up card. Each card has a front or face side 29 and a back side 30. The face side is marked with card-specific information indicating the particular card.

The dealer's hand includes face-down or hole card 27, and face-up card or upcard 28. Since the face-up card shown in FIG. 1 is a ten card, it is possible for the dealer to have a blackjack hand if the face-down card 27 is an ace. A "blackjack hand", or more simply a "blackjack" is a combination of a ten-count card and an ace.

If the casino policy is for the dealer to peek at the face-down card to determine whether there is a blackjack, then there is an increased risk of cheating or inadvertent disclosure of the dealer's hand. This increased risk occurs because the dealer knows his hand and can communicate some indication of it to an accomplice player in ways that are hard to detect or prove.

If the casino policy is to not peek at the face-down card, then all five hands of the players must be played out before the dealer reveals his winning blackjack. However, this wastes time. Thus, it is desirous that the dealer be able to determine whether he holds a blackjack in a selective or limited way not indicating the specific nature of the face-down card unless there is a blackjack. This is called selective determination of dealer blackjack. More specifically, in a preferred embodiment described herein there is selective determination of whether the face-down dealer card is an ace which pairs with a face-up ten-count card to provide a blackjack. This is done by limited visual examination of the face-down card of a special and novel card deck according to this invention. The novel cards of deck 20 allow the dealer to selectively determine whether the ace-down card is an ace, but without learning the specific nature of the face-down card if it is not an ace.

Figure 2:
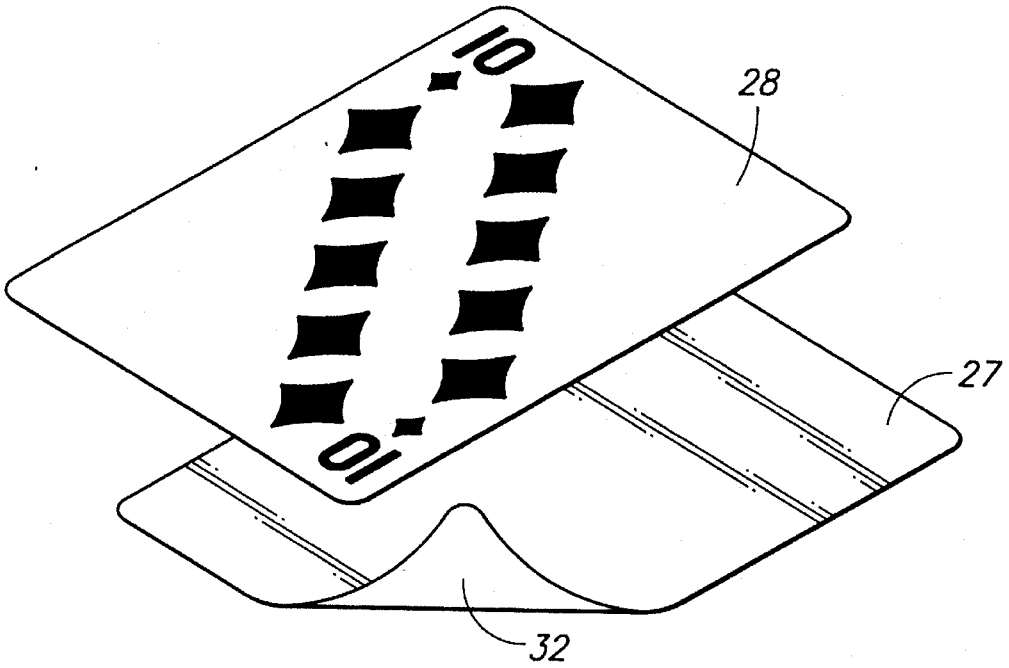
FIG. 2 is a perspective view showing the dealer's hand from FIG. 1 with the dealer peeking at the secondary corner of the face-down card. The face-down card is not an ace so the dealer does not determine the nature of the card.

FIG. 2 illustrates a peek by the dealer at a secondary corner 32 of the face-down card 27. Face-down card 27 is constructed and used in accordance with the novel concepts of this invention. As shown in FIG. 2, the face-down card is not an ace and the secondary corner 32 does not indicate the character of the card. More particularly, in the embodiment shown in FIGS. 2–9, the secondary corner 32 further does not indicate the specific nature of the card or otherwise distinguish it from other cards belonging to a first group of cards, specifically non-ace cards. By specific nature of a card it is meant the suit and character of the card, such as whether it is a two of spades or jack of hearts. With the information available from the secondary corner 32, as shown in FIG. 2, the dealer is unable to determine the specific nature of the face-down card. The dealer is also unable to indicate the count of the dealer's hand, such as to an accomplice. All players will equally know that blackjack does not exist in the dealer hand of FIG. 2 because the dealer would, alter peeking, otherwise indicate he holds a blackjack and immediately close play of that hand.

Figure 3:
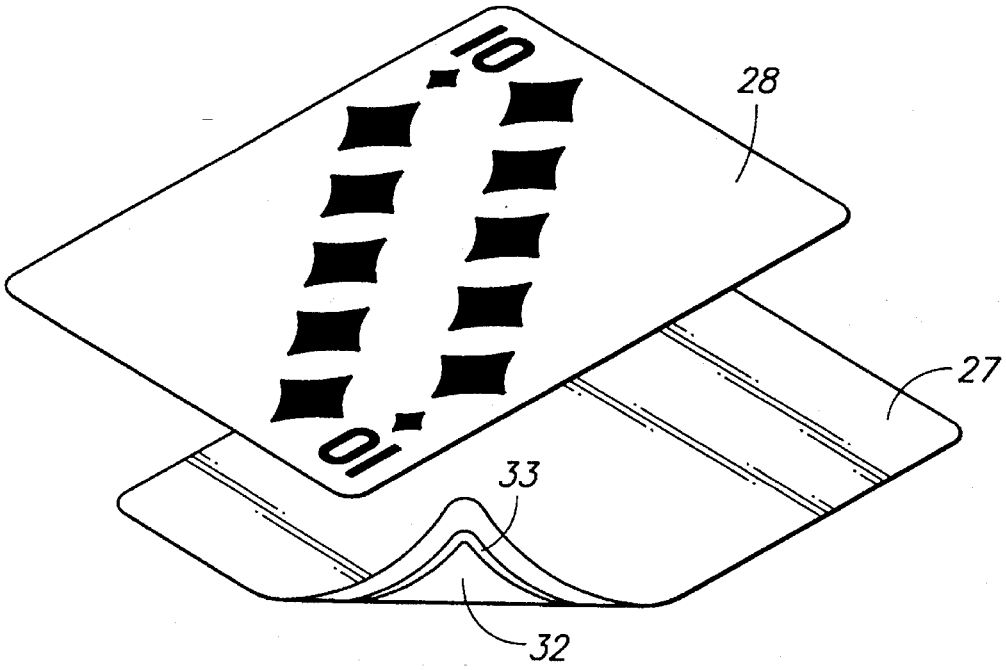
FIG. 3 is an alternative perspective view showing the dealer's hand of FIG. 1 with the dealer peeking at the secondary corner of the face-down card. The face-down card is an ace as indicated by the double perimeter line in the secondary corner.

FIG. 3 shows an alternative possibility for dealer hand 26. In FIG. 3 the face-down card 27 is an ace. The ace is indicated by a distinctive secondary indicia. More specifically, card 27 of FIG. 3 has a secondary corner ace indicator. As shown, this secondary corner ace indicator is in the form of a double line 33 at or near the perimeter of the secondary corner 32. With the dealer hand pictured in FIG. 3, the dealer is able to peek at the secondary corner 32 and determine that a blackjack exists. However, the determination is made without learning the character or count of the face-down card if it is a non-ace.

Figure 4:
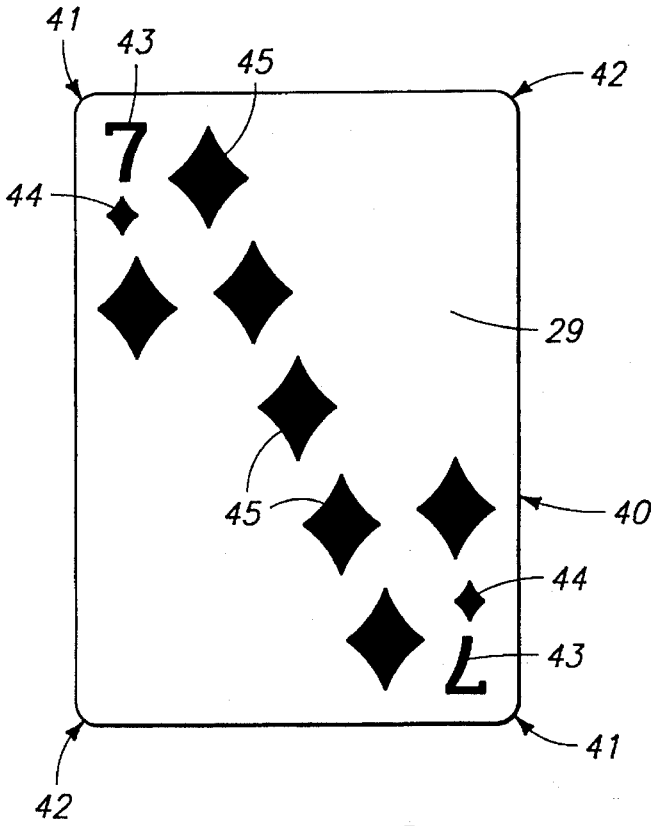
FIG. 4 is a face view of the seven of diamonds card of a preferred card deck according to this invention.

FIGS. 4–7 show exemplary cards from deck 20 made according to the novel concepts of this invention. FIG. 4 shows the face 29 of a seven of diamonds card 40. The face is rectangular and has a pair of diagonally opposing primary corners 41. The face of the card contains card-specific indicia which indicate the specific nature of the card. The card-specific indicia include a character indicator 43, which as shown is the arabic numeral "7". Below or inward from the character indicator 43 is a suit or other class indicator 44. The card specific indicia for card 40 further includes a series of pips 45. Pips 45 are seven in number to additionally indicate the character of the card. The number of pips on the face of any card in the deck 20 is equal to the character of the card for cards with a character of 2 through 10 for each suit.

Novel cards made according to this invention preferably have primary card-specific indicia arranged and positioned on the face of the card so as to not extend into the secondary corners 42. The secondary corners are preferably diagonally opposing corners which are in juxtaposition to the diagonally opposing primary corners 41. This exclusion of count specific indicia from the secondary corners of non-ace cards in the deck is important in the inventive cards and methods of play developed by the inventors.

Figure 5:
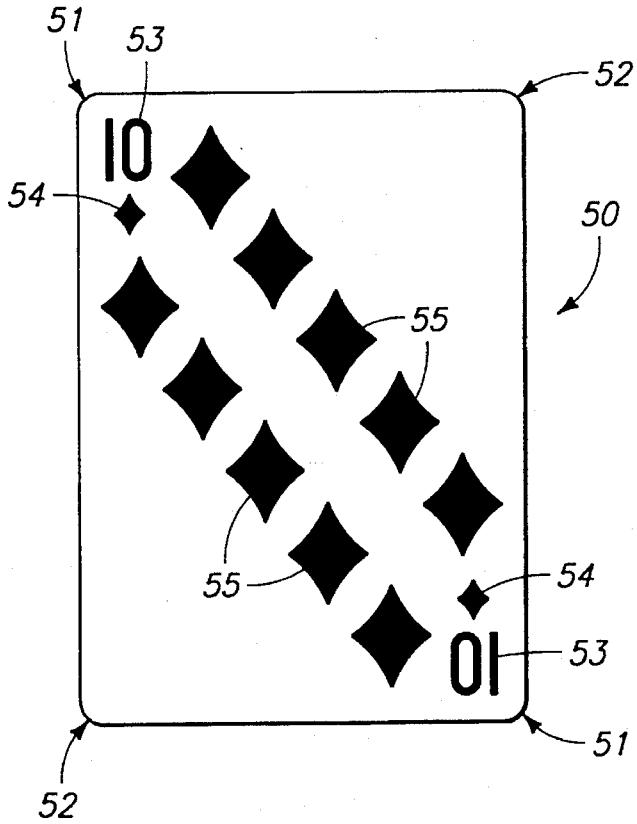
FIG. 5 is a face view of the ten of diamonds card of a preferred card deck according to this invention.

FIG. 5 shows another exemplary card 50 included in a novel deck of cards 20 made in accordance with this invention. Card 50 has diagonally opposing primary corners 51 and secondary corners 52. The face of card 50 also has card-specific primary indicia indicating the specific nature of the card as being a ten of diamonds. The card-specific primary indicia is contained within a diagonal band extending between the opposing primary corners 51. The diagonal band of card-specific indicia includes numerical character indicators 53, which are the arabic numerals "10"; the suit indicators 54; and the ten diamond-shaped pips 55. The secondary corners 52 are non-distinctive, with regard to the count of the card, as compared to secondary corners of all other non-ace cards in the deck 20. As shown, the non-distinctive secondary corners are plain without markings of any type. Alternatively the non-ace cards could have an affirmative marking or markings which are not distinctive, for example similar designs which may or may not indicate suit, but which do not indicate count.

Figure 6:
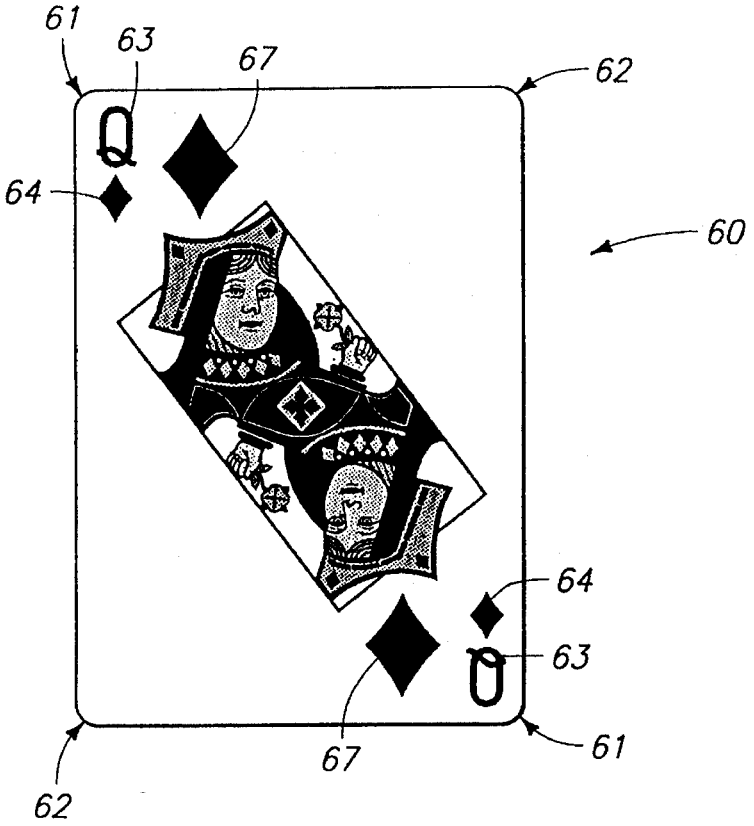
FIG. 6 is a face view of the queen of diamonds card of a preferred card deck according to this invention.

FIG. 6 shows another exemplary card 60 taken from the novel deck 20. Card 60 is the queen of diamonds. Card 60 is a face card having a count or value of ten. The face of card 60 has card-specific primary indicia indicating the specific nature of the card as the queen of diamonds. In the embodiment of FIGS. 2–9, card-specific indicia is contained within a diagonal band extending between the opposing primary corners 61. The diagonal band of card-specific indicia includes alphabetical character indicators 63, which are the letters "Q"; and the suit indicators 64. The secondary corners 62 are non-distinctive, with respect to count, as compared to other secondary corners of all non-ace cards in deck 20. In the embodiment of FIGS. 2–9, the non-distinctive secondary corners are plain without markings of any type.

Figure 7:
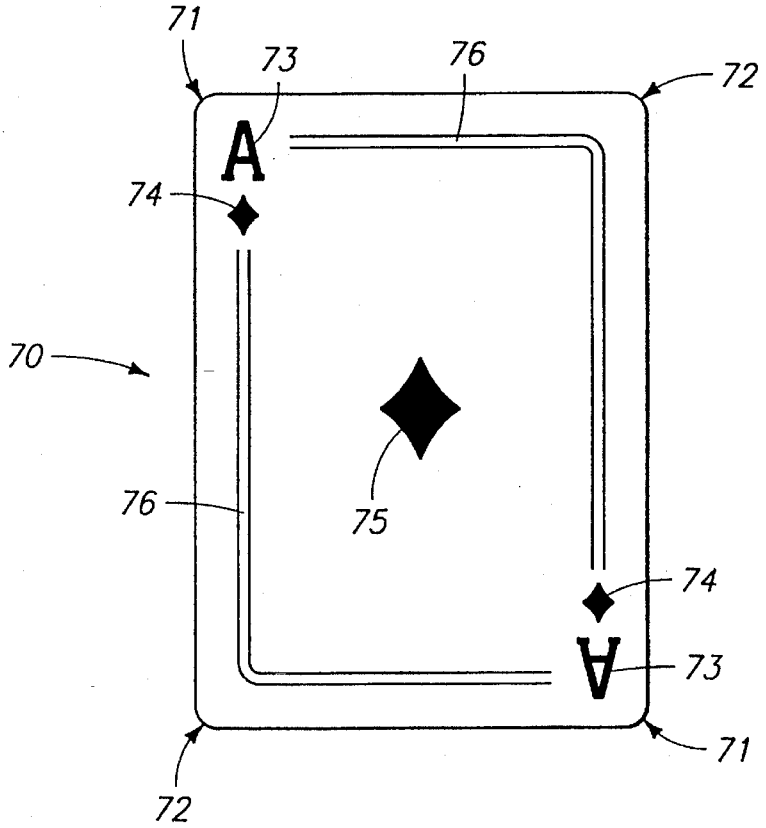
FIG. 7 is a face view of the ace of diamonds card of a preferred card deck according to this invention.

FIG. 7 shows a still further exemplary card 70 taken from deck 20. Card 70 is the ace of diamonds. The face of card 70 has card-specific primary indicia indicating the specific nature of the card as the ace of diamonds. The card-specific primary indicia is contained within a diagonal band extending between the opposing primary corners 71. The diagonal band of card-specific primary indicia includes alphabetical character indicators 73, which are the letter "A"; the suit indicators 74; and one diamond-shaped pip 75.

FIG. 7 also shows the characterizing secondary indicia used to indicate a member of the second group or subset of cards used to make a blackjack hand; specifically, the aces. The secondary corners 72 are distinctive of members of the subset forming a part of deck 20. Deck 20 includes a second subset having the four aces of the four common card suits. The secondary indicia are preferably secondary corner ace indicia provided in the secondary corners 72. The secondary corner indicia are distinctive of blackjack hand cards, as compared to other secondary corners of all non-ace cards in deck 20. As shown, distinctive secondary indicia 76 are perimeter corner markings contained in the opposing secondary corners 72. Secondary indicia 76 are perimeter lines drawn adjacent to the perimeter edges of the secondary corners 72. The perimeter indicia lines are most preferably dual lines which extend across both the long and short edges adjacent to the secondary corners.

Figure 8B:
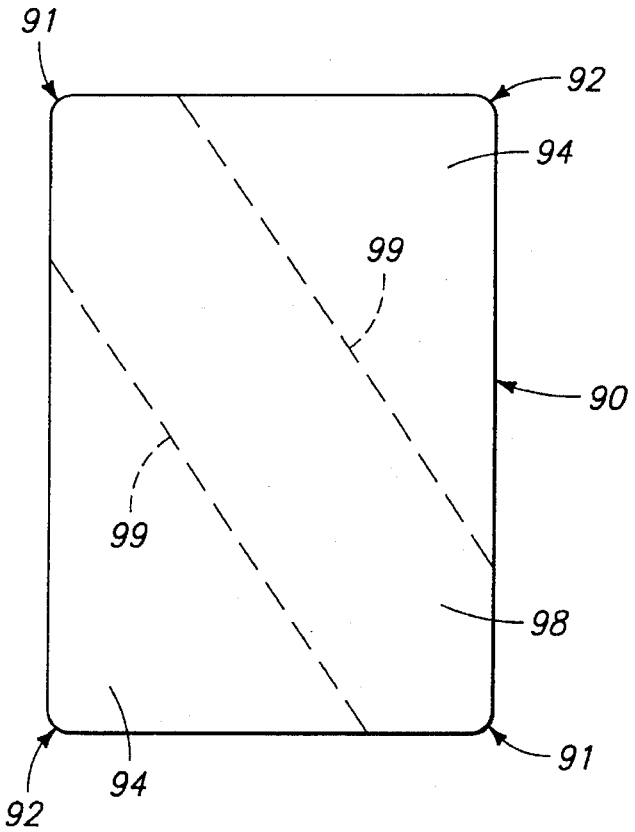
FIG. 8 is a diagrammatic face view illustrating cards contained in a first group of cards forming a part of a preferred card deck according to this invention.

FIG. 8 shows a schematic illustration of a first subset card 90 exemplifying a first subset or group of cards forming a part of the deck 20. Members of this first subset or group include cards 40, 50 and 60 described hereinabove, and the remaining non-ace cards of deck 20. FIG. 8 shows a primary indicia zone 98. As shown, the primary indicia zone 98 is bounded by the primary corners 91 and adjacent portions of the short and long sides of the card. Diagonal primary zone boundaries 99 further serve to illustrate a preferred ambit of the primary indicia zone 98.

FIG. 8 also shows secondary indicia zones 94 which approximate the secondary corners 92. The secondary indicia corner zones 94, defining secondary corners, lie between the diagonal boundaries 99 and the edges of the card.

Figure 9:
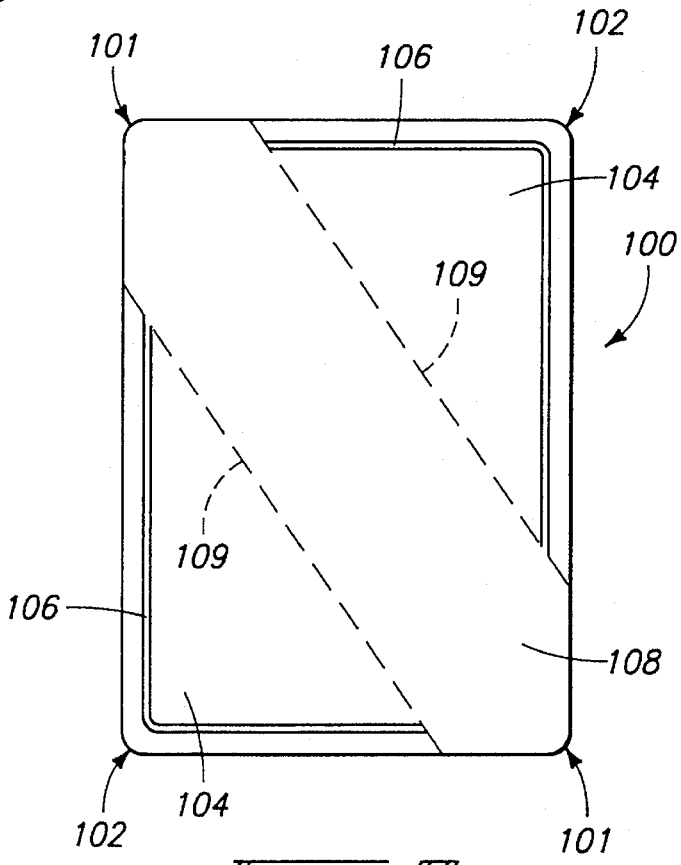
FIG. 9 is a diagrammatic face view illustrating cards contained in a second group of cards forming a part of a preferred card deck according to this invention.

FIG. 9 shows another schematic illustration of a second subset card 100 exemplifying a second group or subset of cards forming a part of deck 20. The secondary group is exemplified by ace 70 of FIG. 7. The second subset is complementary to the first subset in that the members of the first and second subsets together comprise the entire deck. Card 100 has a primary indicia zone 108. The primary indicia zone 108 is bounded by the primary corners 101 and adjacent portions of the short and long sides of the card. Diagonal primary zone boundaries 109 further serve to illustrate the boundaries of the primary indicia zone 108.

Card 100 also has secondary indicia zones 104. Contained within the secondary indicia zones are secondary indicia 106, advantageously in the form of dual marginal lines adjacent to the short and long edges within the diagonally opposing secondary corners 102.

Figure 11:
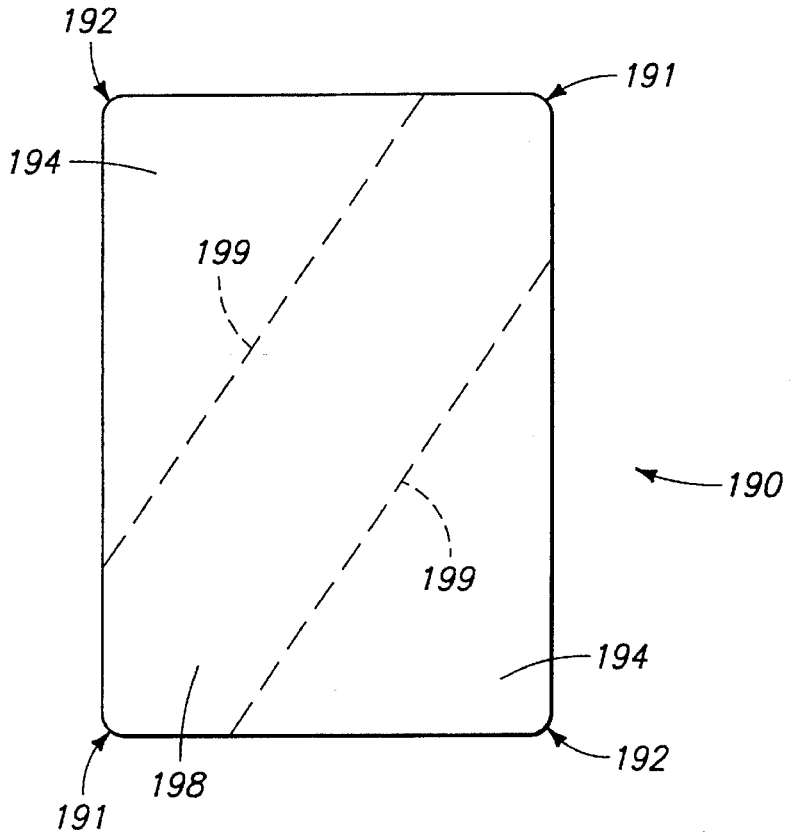
FIG. 11 is a diagrammatic face view illustrating cards contained in a second group of cards forming a part of the second alternative preferred card deck according to this invention.

FIGS. 10 and 11 show schematic cards 190 and 200 which are analogous to the first and second subset cards 90 and 100. Corresponding numbering has been used to indicate the similar features except that the leading 9 has been changed to a leading 19, for example 94 corresponds to 194. Similarly for FIG. 11, 200 numbers correspond to 100 numbers. The relative relationships of the primary and secondary corners is inverted in cards 190 and 200 relative to the cards in deck 20.

The primary indicia zones are preferably sized to cover approximately 70–30 percent of the face area of the cards. Conversely, the secondary indicia zones are preferably sized to approximately cover a complementary 30–70 percent of the face area of the cards.

Shown in FIGS. 12–19 is a third alternative novel deck of cards that embody the invention. This deck is similar to the deck shown in FIGS. 2–9 in that it has cards of a first group, namely non-aces, with secondary corners that are non-distinctive with respect to count. This deck also has cards of a second group, namely aces, with distinctive secondary corners. The deck of FIGS. 12–19 is different from the deck shown in FIGS. 2–9 because non-ace cards all have a single pip in each of their secondary corners and have a pip enclosing border, as will be described below in more detail.

Figure 12:
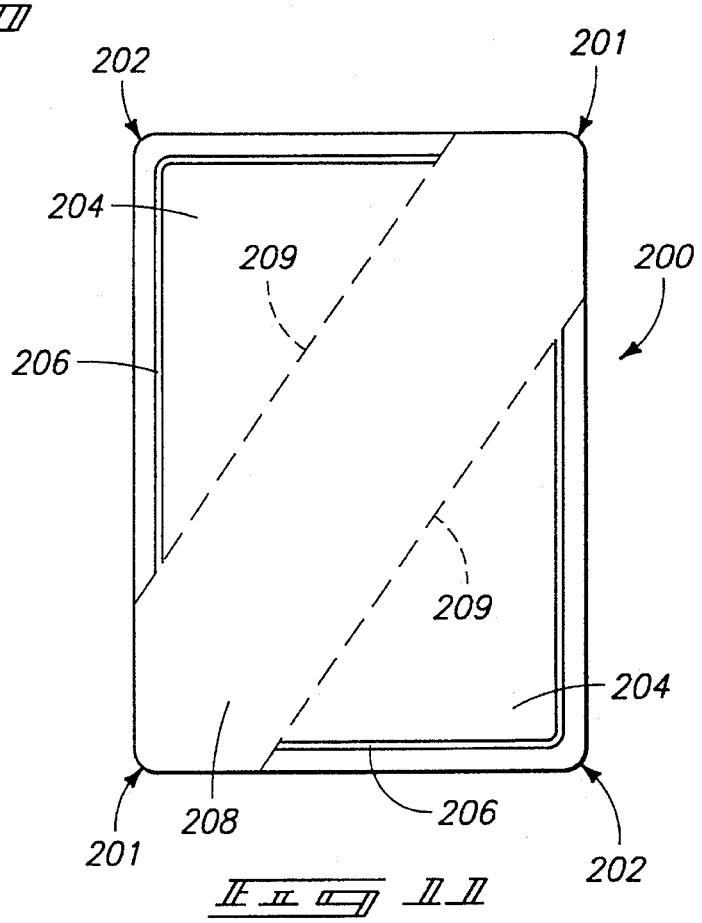
FIG. 12 is an alternative perspective view showing a dealer's hand, using cards forming a part of a third alternative preferred card deck according to this invention, with the dealer peeking at the secondary corner of the face-down card. The face-down card is not an ace so the dealer does not determine the nature of the card. The single line border and single pip in the secondary corner indicates that the face-down card is not an ace.
Figure 12:
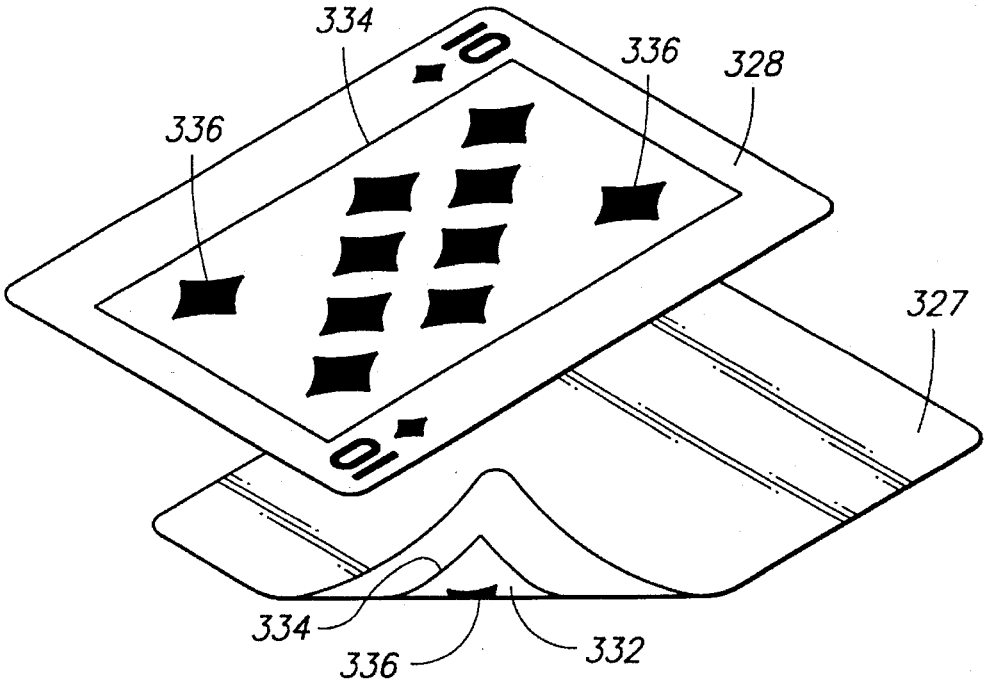
Figure 13:
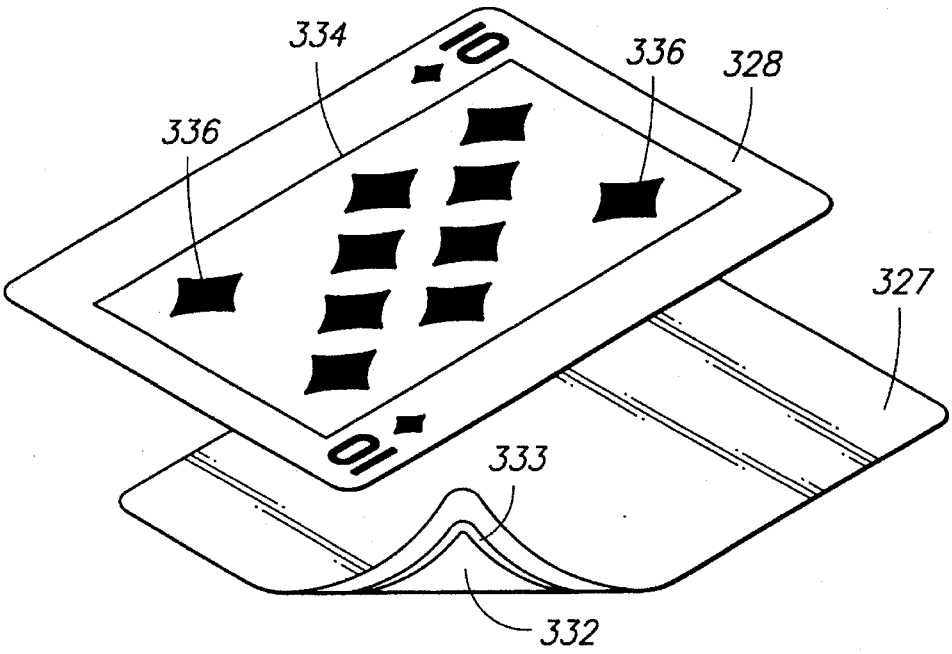
FIG. 13 is an alternative perspective view showing a dealer's hand using cards forming a part of the third alternative preferred card deck of FIG. 12, with the dealer peeking at the secondary corner of the face-down card. The face-down card is an ace as indicated by the double perimeter line in the secondary corner.

FIGS. 12 and 13 illustrate dealer hands when a dealer uses the third alternative deck embodying the invention. The dealer hands each include a face up card 328 and a face down card 327.

FIG. 12 illustrates a peek by the dealer at a secondary corner 332 of face-down card 327. Face-down card 327 is constructed and used in accordance with the novel concepts of this invention. As shown in FIG. 12, the face-down card is not an ace and the secondary corner 332 does not indicate the specific character of the card or otherwise indicate the count of the card. The information displayed in the secondary corner 332, as shown in FIG. 12, is simply a portion of a pip-enclosing border or count recognition box 334, and a single pip 336. A portion of a pip-enclosing border and a single pip would be displayed by every other non-ace card in the deck so the dealer is unable to determine the specific count of the face-down card. The dealer is also unable to indicate the count of the dealer's hand, such as to an accomplice. All players will equally know that blackjack does not exist in the dealer hand of FIG. 12 because the dealer would, after peeking, otherwise indicate he holds a blackjack and immediately close play of that hand.

FIG. 13 shows an alternative possibility for a dealer hand. In FIG. 13 the face-down card 327 is an ace. The ace is indicated by a distinctive secondary indicator. More specifically, card 327 of FIG. 13 has a secondary corner ace indicator. As shown, this secondary corner ace indicator is in the form of a double line 333 at or near the perimeter of the secondary corner 332. With the dealer hand pictured in FIG. 13, the dealer is able to peek at the secondary corner 332 and determine that a blackjack exists. However, the determination is made without learning the specific nature of the face-down card if it is a non-ace.

Figure 14:
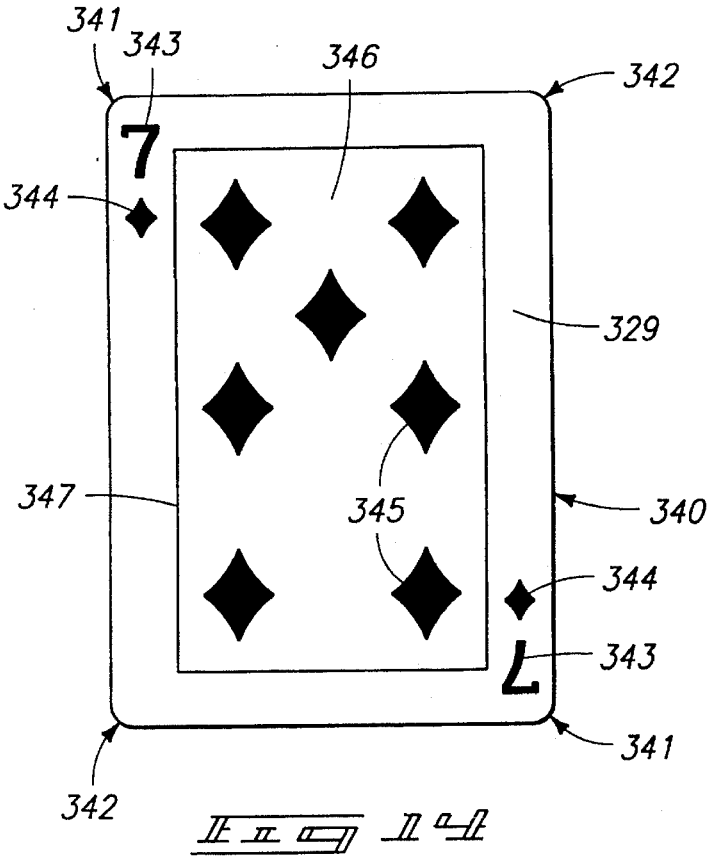
FIG. 14 is a face view of the seven of diamonds card of the third alternative preferred card deck according to this invention.

FIGS. 14–17 show exemplary cards from the third alternative deck made according to the novel concepts of this invention. FIG. 14 shows the face 329 of a seven of diamonds card 340. The face is rectangular and has a pair of diagonally opposing primary corners 341. The face of the card contains card-specific indicia which indicate the specific nature of the card. The card-specific indicia include a character indicator 343, which as shown is the arabic numeral "7". Below or inward from the character indicator 343 is a suit or other class indicator 344. The card specific indicia for card 340 further includes a series of pips 345, contained within a center region 346 of the card. The center region 346 is delineated by a center region borderline or count recognition box 347. The count recognition box 347 helps make the cards of the third alternative deck look similar in appearance to a conventional deck of cards. The border 347 also focuses the attention of an observer onto the count specific indicia of the card. Thus, a supervisor observing the card game through an "eye-in-the-sky," can discern the specific indicia of the card that is contained in the border 347. Thus, even though the supervisor may be too far away to discern the numbers 343 on the card, the supervisor can quickly determine the count of the card from the pip pattern in the count recognition box 347.

Pips 345 are seven in number for this card and arranged in a pattern specific to the character of the card so that the count of the card is indicated to a person observing only the count-recognition box 347 of the card. The number of pips on the face of any card with a character of 2 through 10 in the deck shown in FIGS. 12–20 corresponds to the character of the card, and includes one pip in each secondary corner 342, and includes remaining pips arranged in a diagonal band extending between the diagonally opposed primary corners.

The secondary corners 342 are diagonally opposing corners which are in juxtaposition to the diagonally opposing primary corners 341. A single pip 345 is contained in each secondary corner, in the intersection zone between the secondary corner and the count recognition box 347 for every non-ace card in the deck shown in FIGS. 12–20, including ace cards. Thus, it is impossible for a dealer to determine the count of a non-ace card by peeking at a secondary corner 342.

Figure 15:
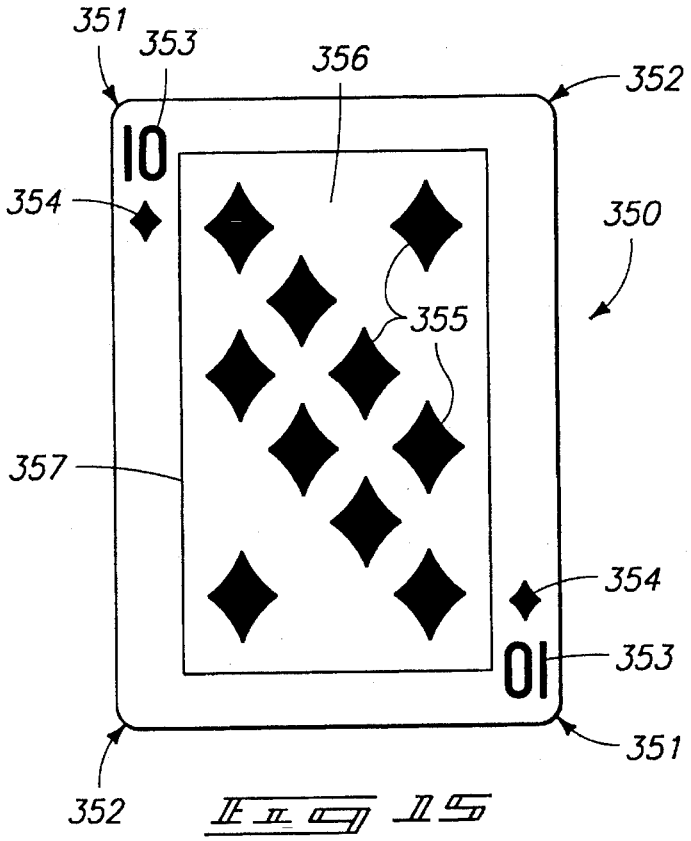
FIG. 15 is a face view of the ten of diamonds card of the third alternative preferred card deck according to this invention.

FIG. 15 shows another exemplary card 350 included in the third alternative deck of cards. Card 350 has diagonally opposing primary corners 351 and secondary corners 352. The face of card 350 also has card-specific primary indicia indicating the specific nature of the card as being a ten of diamonds. The card-specific primary indicia includes ten pips 355 contained within a count recognition box 357. One pip 355 is contained in each secondary corner 352, in the intersection zone of the secondary corner and a center region 356 of the card. The remaining eight pips are all contained in a diagonal band extending between the opposing primary corners 351. The diagonal band further includes numerical character indicators 353, which are the arabic numerals "10"; and the suit indicators 354. The secondary corners 352 are non-distinctive with regard to count as compared to secondary corners of all other non-ace cards in deck shown in FIGS. 12–21. As shown, the non-distinctive secondary corners each include a single pip 355. Alternatively the non-ace cards could have other markings which are not distinctive with regard to count.

Figure 16:
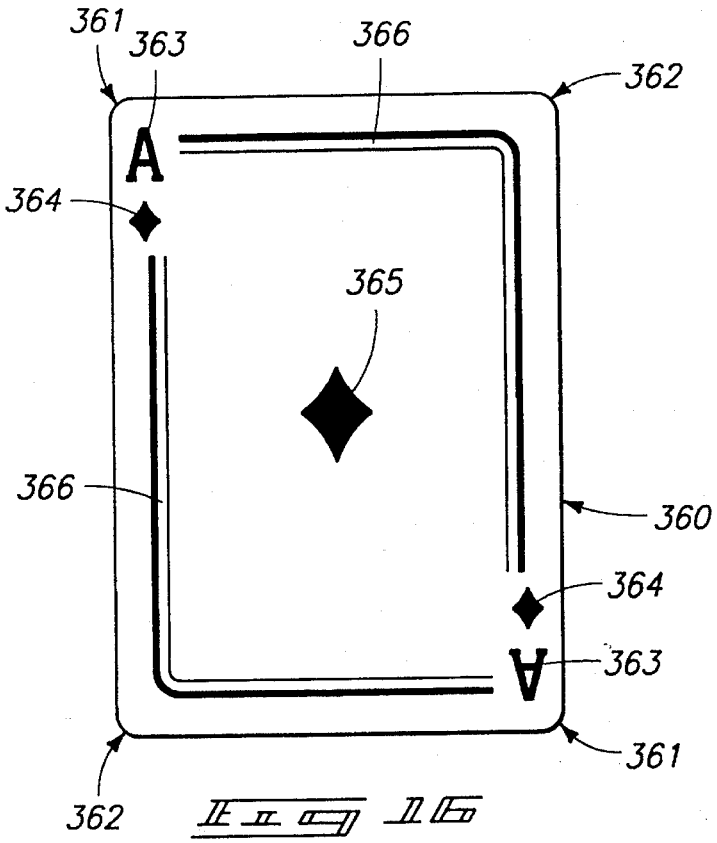
FIG. 16 is a face view of the ace of diamonds card of the third alternative preferred card deck according to this invention.

FIG. 16 shows another exemplary card 360 taken from the third alternative preferred deck. Card 360 is the ace of diamonds. The face of card 360 has card-specific primary indicia indicating the specific nature of the card as the ace of diamonds. The card-specific primary indicia is contained within a diagonal band extending between the opposing primary corners 361. The diagonal band includes alphabetical character indicators 363, which are the letter "A"; the suit indicators 364; and one diamond-shaped pip 365.

FIG. 16 also shows the characterizing secondary indicia used to indicate a member of the second group or subset of cards used to make a blackjack hand; specifically, the aces. The secondary corners 362 are distinctive of members of the second group or subset of cards forming a part of deck 20. The deck of FIGS. 12–19 includes a second group or subset of cards having the four aces of the four common card suits. The secondary indicia are preferably secondary corner ace indicia provided in the secondary corners 362. The secondary corner indicia are distinctive of blackjack hand cards, as compared to other secondary corners of all non-ace cards in deck 20. As shown, distinctive secondary indicia 362 are perimeter corner markings 366 contained in the opposing secondary corners 362. Secondary indicia 362 are perimeter lines drawn adjacent to the perimeter edges of the secondary corners 362. The perimeter indicia lines are most preferably dual lines which can be extended across both the long and short edges adjacent to the secondary corners.

Figure 17:
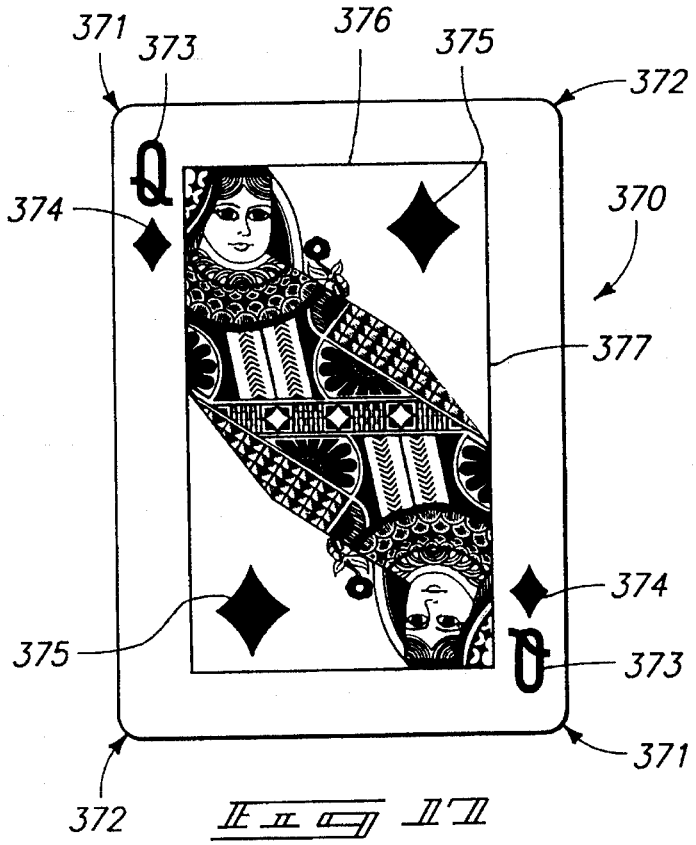
FIG. 17 is a face view of the queen of diamonds card of the third alternative preferred card deck according to this invention.

FIG. 17 shows another exemplary card 370 taken from the third alternative preferred deck, and included in the first group or subset. Card 370 is the queen of diamonds. Card 370 is a face card having a count or value of ten. The face of card 370 has card-specific primary indicia indicating the specific nature of the card as the queen of diamonds. The card-specific indicia is contained within a diagonal band extending between the opposing primary corners 371. The diagonal band of card-specific indicia includes alphabetical character indicators 373, which are the letters "Q"; and the suit indicators 374. The face of card 370 also includes count-recognition box 377. The secondary corners 372 are non-distinctive, with respect to count, as compared to other secondary corners of other non-ace cards in deck 20 and each contain a single pip 375. A single pip 375 is contained in the intersection of the center region 376 and each secondary corner 372.

Figure 18:
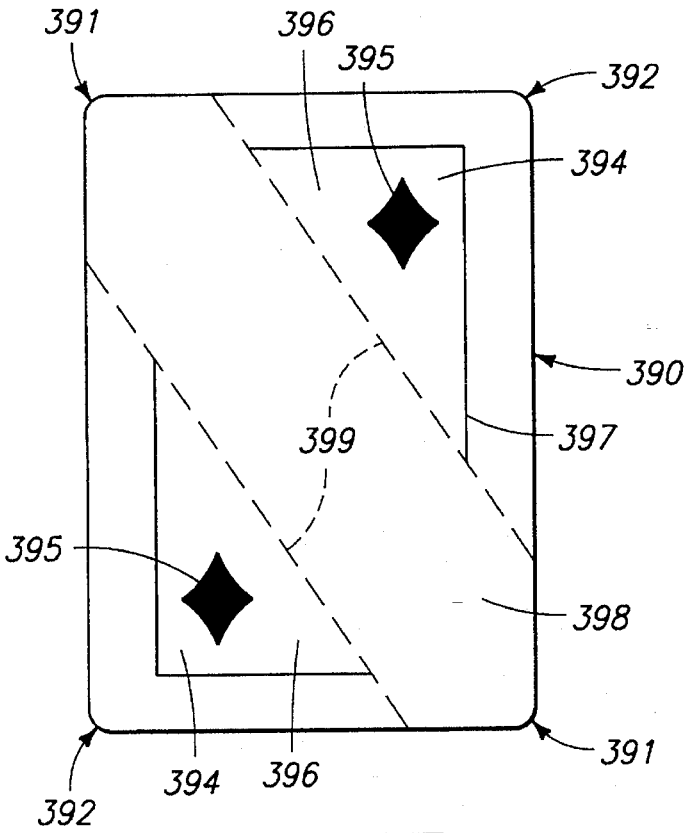
FIG. 18 is a diagrammatic face view illustrating cards contained in a first group of cards forming a part of the third alternative preferred card deck according to this invention.

FIG. 18 shows a schematic illustration of a first subset card 390 exemplifying a first subset or primary group of cards forming a part of third alternative preferred deck. Members of this first subset include cards 340, 350 and 360 described hereinabove, and the remaining non-ace cards of the third alternative preferred deck. FIG. 18 shows a primary indicia zone 398. As shown, the primary indicia zone 398 is bounded by the primary corners 391 and adjacent portions of the short and long sides of the card. Diagonal primary zone boundaries 399 serve to illustrate the boundaries of secondary corners 392. A single pip 395 is contained in the intersection zone of a center region 396 of the card with each of the secondary corners 392; that is, outside the boundaries 399 and inside a pip-enclosing border 397.

FIG. 18 also shows secondary indicia zones 394 which approximate the secondary corners 392. The secondary indicia zones 394 lie between the diagonal boundaries 399 and the edges of the card.

Figure 19:
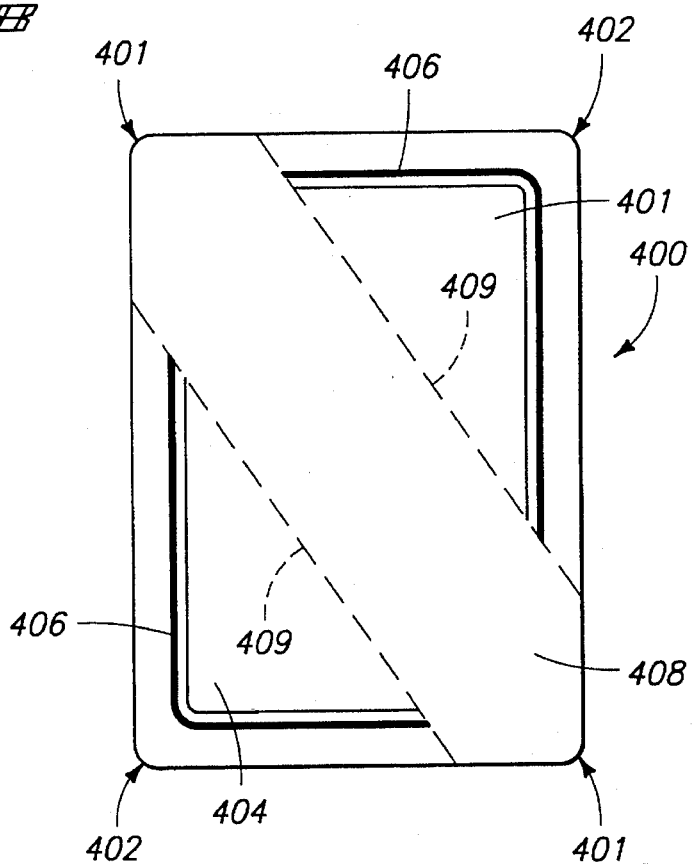
FIG. 19 is a diagrammatic face view illustrating cards contained in a second group of cards forming a part of the third alternative preferred card deck according to this invention.

FIG. 19 shows a schematic illustration of a second subset card 400 exemplifying a second group or subset of cards forming a part of the third alternative preferred deck 20. The secondary group is exemplified by ace 360 of FIG. 16. The second subset is complementary to the first subset in that the members of the first and second subsets together comprise the entire deck. Card 400 has a primary indicia zone 408. The primary indicia zone 408 is bounded by the primary corners 401 and adjacent portions of the short and long sides of the card. Diagonal primary zone boundaries 409 further serve to illustrate the boundaries of the primary indicia zone 408.

Card 400 also has secondary indicia zones 404. Contained within the secondary indicia zones are secondary indicia 406, advantageously in the form of dual marginal lines adjacent to the short and long edges within the diagonally opposing secondary corners 402.

The primary indicia zones are preferably sized to cover approximately 70–30 percent of the face area of the cards. Conversely, the secondary indicia zones are preferably sized to approximately cover a complementary 30–70 percent of the face area of the cards.

This invention further includes novel methods for playing the card game alternatively known as blackjack or twenty-one. The game includes play by at least one player and one dealer. The methods include dealing two cards to each player and the dealer. The players' cards are both typically dealt either faceup or facedown. In the case of the dealer, one card is dealt faceup and the other card is dealt facedown. The dealer then performs by considering whether the dealer can have a total hand count of twenty-one based upon the count of the face-up card. If there is a possibility of the dealer having a blackjack hand, then the dealer selectively peeks at a secondary corner of the face-down card to view illustrative portions of the secondary indicia zone contained thereon. The dealer performs by peeking and thereby viewing or visually determining whether the secondary corner includes a distinctive visually perceivable secondary indicia indicating the face-down card is a member of a secondary group or subset which provides a blackjack hand to the dealer. If so, then the dealer proceeds by ending play of the hand and declaring the dealer the winner. The dealer does not win against a player who also has a blackjack hand. Alternatively, if the dealer peeks to visually determine that the face-down card is a member of a primary group or subset which does not have distinctive secondary indicia and does not provide a blackjack hand, then the dealer performs by continuing play to the other player or players.

In preferred methods of this invention, when an ace is up, the dealer checks for a blackjack hand by simply inspecting the primary indicia of the hole card. The ace up situation is less frequent than having a ten-count card faceup and knowledge of the hole card value when an ace is the dealer's upcard is of much less potential damage to the casino. This is true because players cannot use this information to gain a significant statistical advantage.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A playing card deck, comprising:

a series of cards each having a face and a back; said series of cards being organized into a plurality of suits each including ace cards and non-ace cards;

the faces of said cards each having specific indicia thereon said specific indicia being distinctive to indicate the specific numerical count of the card;

the faces of said cards each having a primary zone and a pair of secondary corner zones; said secondary corner zones together comprising at least 30 percent of the surface area of the non-ace cards;

wherein the secondary corner zones of said non-ace cards do not contain sufficient information to indicate the numerical count of the card;

wherein the secondary corner zones of said ace cards indicate the card is an ace.

2. The card deck of claim 1 wherein the secondary corner zones of the non-ace cards are vacant.

3. The card deck of claim 1 wherein the secondary corner zones of the non-ace cards contain designs which are not indicative of the numerical count of the cards.

4. The card deck of claim 1 wherein the secondary corner zones of the non-ace cards contain a suit indicating pip.

5. The card deck of claim 1 wherein the secondary corner zones comprise 30 to 70 percent of the face of the cards.

6. The card deck of claim 1 wherein each of the secondary corner zones of the non-ace cards contains a single pip.

7. The card deck of claim 1 wherein the secondary corner zones of the non-ace cards contains a single pip and a portion of a pip-enclosing border.

8. The card deck of claim 1 wherein the secondary corner zones of the ace cards contains a symbol near secondary corners thereof.

9. The card deck of claim 1 wherein the secondary corner zones of the ace cards contains a symbol near secondary corners thereof, said symbol being at least one line.

10. The card deck of claim 1 wherein the secondary corner zones of the ace cards contains a symbol near secondary corners thereof, said symbol being a dual perimeter line.

11. The card deck of claim 1 wherein there are four suits, with one of the aces in each suit, and with a two, three, four, five, six, seven, eight, nine, ten, jack, queen, and king card making up the non-ace cards in each suit.

12. A playing card deck, comprising:

a series of cards each having a ace and a back; said series of cards being organized into a plurality of suits each including ace cards and non-ace cards;

the faces of said cards each having specific indicia thereon said specific indicia being distinctive to indicate the specific numerical count of the card;

the faces of said cards each having a primary zone and a pair of secondary corner zones; said secondary corner zones together comprising at least 30 percent of the surface area of the non-ace cards;

the faces of said non-ace cards having a center region and a center region borderline which at least partially extends about and defines the center region;

wherein the secondary corner zones of said non-ace cards do not contain sufficient information to indicate of;the numerical count of the card;

wherein the secondary corner zones of said ace cards indicate the card is an ace.

13. The card deck of claim 12 wherein diagonal boundaries define between the primary zone and the secondary corner zones; said diagonal boundaries being positioned to cut through the center region.

14. The card deck of claim 12 wherein diagonal boundaries define between the primary zone and the secondary corner zones; said diagonal boundaries being positioned to cut through the center region to define center region intersection zones.

15. The card deck of claim 12 wherein diagonal boundaries define between the primary zone and the secondary corner zones; said diagonal boundaries being positioned to cut through the center region to define center region intersection zones; said center region intersection zones for non-ace cards containing at least one pip.

16. The card deck of claim 12 wherein diagonal boundaries define between the primary zone and the secondary corner zones; said diagonal boundaries being positioned to cut through the center region to define center region intersection zones; said center region intersection zones for non-ace cards containing one pip which is similarly located for all non-ace cards.

17. The card deck of claim 12 wherein the secondary corner zones comprise 30 to 70 percent of the ace of the cards.

18. The card deck of claim 12 wherein the secondary corner zones of the ace cards contains a symbol near secondary corners thereof, said symbol being at least one line.

19. The card deck of claim 12 wherein the secondary corner zones of the ace cards contains a symbol near secondary corners thereof, said symbol being a dual perimeter line.

20. The card deck of claim 12 wherein there are four suits, with one of the aces in each suit, and with a two, three, four, five, six, seven, eight, nine, ten, jack, queen, and king card making up the non-ace cards in each suit.

21. The card deck of claim 12 wherein the center region borderline forms a substantially rectangular count-recognition box within which are located an arrangement of pips which indicate the numerical count of non-ace cards except the jack, queen and king cards.

22. A method for playing the card game blackjack or casino twenty-one involving at least one dealer and at least one player, comprising:

selecting at least one blackjack deck of cards having:

a series of cards each having a face and a back; said series of cards being organized into a plurality of suits each including a first group and a second group;

the faces of said cards each having specific indicia thereon said specific indicia being distinctive to indicate the specific numerical count of the card;

the faces of said cards each having a primary zone and a pair of secondary corner zones; said secondary corner zones together comprising at least 30 percent of the surface area of the cards;

wherein the secondary corner zones of said first group of cards do not contain sufficient information to indicate of the numerical count of the card;

wherein the secondary corner zones of said second group of cards indicate the card is a member of the second group;

dealing two cards to each player and the dealer, the cards to the dealer being one facedown card and one aceup card;

considering whether the dealer can have a total hand count of twenty one based upon the count of the aceup card of the dealer;

lifting a secondary corner of said facedown card of the dealer;

peeking by directly viewing the secondary corner of the dealer facedown card which has been lifted to see if the card is either a member of the first group or second group of cards;

ending the play of a hand of cards if the dealer total hand count equals twenty-one after the dealer has only received two cards.

23. A method according to claim 22 wherein the first group includes non-ace cards and the second group includes the ace cards.

24. A method for playing the card game blackjack or casino twenty-one involving at least one dealer and at least one player, comprising:

selecting at least one blackjack deck of cards having:

a series of cards each having a face and a back; said series of cards being organized into a plurality of suits each including ace cards and non-ace cards;

the faces of said cards each having specific indicia thereon said specific indicia being distinctive to indicate the specific numerical count of the card;

the faces of said cards each having a primary zone and a pair of secondary corner zones; said secondary corner zones together comprising at least 30 percent of the surface area of the non-ace cards;

wherein the secondary corner zones of said non-ace cards do not contain sufficient information to indicate of the numerical count of the card;

wherein the secondary corner zones of said ace cards indicate the card is an ace;

dealing two cards to each player and the dealer, the cards to the dealer being one facedown card and one faceup card;

considering whether the dealer can have a total hand count of twenty-one based upon the count of the faceup card of the dealer;

lifting a secondary corner of said facedown card of the dealer;

peeking by directly viewing the secondary corner of the dealer facedown card which has been lifted to see if the card is a non-ace card, or an ace card which produces a dealer total hand count of twenty-one; and ending the play of a hand of cards if the dealer total hand count equals twenty-one after the dealer has only received two cards.

* * * * *